United States Patent [19]

Perkins

[11] Patent Number: 4,781,289

[45] Date of Patent: Nov. 1, 1988

[54] SELF-SUPPORTING DISPLAY PACKAGE

[75] Inventor: William H. Perkins, Oxford, Ohio

[73] Assignee: The Drackett Company, Cincinnati, Ohio

[21] Appl. No.: 188,754

[22] Filed: Apr. 29, 1988

Related U.S. Application Data

[63] Continuation of Ser. No. 31,621, Mar. 30, 1987, abandoned.

[51] Int. Cl.[4] ..... B65D 5/52; B65D 25/24

[52] U.S. Cl. ..... 206/45.24; 206/461

[58] Field of Search ..... 206/461, 45.24, 44 R, 206/45.14, 45.21, 45.25, 45.31

[56] References Cited

U.S. PATENT DOCUMENTS

| | | | |
|---|---|---|---|
| D. 185,890 | 8/1959 | Barton . | |
| D. 250,092 | 10/1978 | Schoenfield et al. . | |
| D. 267,394 | 12/1982 | Liptak et al. . | |
| D. 273,277 | 4/1984 | Strauss . | |
| D. 277,731 | 2/1985 | Sharp et al. . | |
| 2,937,746 | 5/1960 | Ferguson . | |
| 3,093,244 | 6/1963 | Middleton, Jr. et al. . | |
| 3,289,830 | 12/1966 | Foote . | |
| 3,399,763 | 9/1968 | Stone . | |
| 4,014,134 | 3/1977 | Womack, Jr. | 206/461 |
| 4,326,546 | 4/1982 | Acker | 206/461 |
| 4,531,637 | 7/1985 | Cusmano | 206/461 |
| 4,669,610 | 6/1987 | Lindsey et al. | 206/461 |

*Primary Examiner*—Joseph Man-Fu Moy

*Attorney, Agent, or Firm*—Gene Warzecha

[57] ABSTRACT

A vertically standing display package having a single vertical display panel for receiving, on one side thereof, a preformed blister pack structure having integrally formed therein a cup-shaped product enclosure and a support. The blister pack structure is in the form of a U-shaped planar base having two parallel, equal length legs extending downwardly on each side of the product enclosure. The support portion of the blister pack structure bridges the two legs and has a three-sided bottom edge coplanar with the ends of the legs. All surfaces of the display package are either parallel to its base plane or at a positive draft angle relative thereto in order to enable intimate stacking of a plurality of display packages and automatic feeding during manufacture.

12 Claims, 1 Drawing Sheet

SELF-SUPPORTING DISPLAY PACKAGE

This is a continuing application of Application Ser. No. 31,621 filed Mar. 30, 1987 now abandoned.

BACKGROUND OF THE INVENTION

1. FIELD OF THE INVENTION

The invention relates to self-supporting, vertically free-standing display packages for displaying a product. More particularly, the invention relates to a blister pack display package having a preformed product enclosure attached to a paperboard back and provided with an integral support structure to form a vertically free-standing unit.

2. DESCRIPTION OF THE PRIOR ART

Numerous packaging concepts are known in the prior art for displaying a variety of products in many different ways. The choice of packaging concept depends greatly upon the ultimate effect which is desired to be presented to the consumer.

This invention relates to those types of situations and products where it is desired to present products to the consumer in a plurality of independent packages, each free-standing vertically on a horizontal support surface. While in some types of packages the vertical support is provided by folded panels of paperboard, this invention pertains to packages in which the support is provided solely by the blister material either itself or in cooperation with the paperboard to which the blister is attached. An example of vertically self-supporting display package utilizing a single paperboard panel (folded so as to have a substantially rectangular frame extending to the same side of a display panel as the product) is shown in a co-pending application entitled "Vertically Self-Supporting Display Package", Ser. No. 934,045, filed Nov. 24, 1986 and assigned to the assignee hereof. This and other such display packages, however, are relatively complex and costly and it is, therefore, an object of this invention to produce a simpler vertically self-supporting blister package which is less costly. It will be understood that the terms "blister" and "blister pack" as used herein mean any one of a variety of plastic materials, usually transparent, that may be molded or vacuum formed to contain a product.

Many prior art, vertically self-supporting blister pack display packages are provided with a supporting structure integrally formed at the bottom of the blister pack. These supporting structures may take the form of one or more bottom, flat surfaces formed into the blister material, the surface or surfaces being sufficiently large to maintain the entire package in a vertical orientation. Examples of these "surface-support" type packages are shown in U.S. Design Pat. Nos. 185,890 (Barton), 250,092 (Schoenfield et al) and 273,277 (Strauss) and in utility U.S. Pat. No. 3,093,244 (Middleton Jr., et al). In packages of this type the vertical orientation of the package is maintained independently of the paperboard back panel to which the blister pack is secured.

Supporting structures may also take the form of one or more foot-type protrusions of the blister material. This construction provides vertical support through the three-point cooperative action between the protrusion(s) and other parts of the package. Examples of "foot-support" type packages are shown in U.S. Pat. Nos. 3,399,763 (Stone) and 3,289,830 (Foote).

Both the surface-support and foot-support type packages require additional blister material to form the necessary structure. This increases the complexity and cost of the packages. Even in the relatively simple foot-type packages, the supporting foot and the blister material connecting it to the body of the package must be relatively thick to be strong enough to support the weight of certain products. For products above a certain weight such packages are inappropriate. Additionally, because of the inherent downwardly directed angle of the foot relative to the base of the blister pack in some packages (such as Foote, above), some blister packs do not easily lend themselves to automated display package assembly (i.e. such blister packs cannot be run on automatic equipment because of the reverse draft angle of the foot). Additionally, if the vertical orientation is to be maintained by the cooperative action of the foot and the paperboard back, slight displacements in the positioning of the blister on the paperboard will result in non-vertical packages.

It is another object of this invention to provide a vertically self-supporting display package which overcomes the foregoing disadvantages of the prior art.

It is also an object of this invention to provide a self-supporting blister package which may be stacked to facilitate automated production of display packages.

It is an additional object of this invention to provide a self-supporting display package for displaying a product in a vertical orientation while occupying a minimum amount of shelf space.

It is yet another object of this invention to provide a self-supporting display package which is relatively lightweight and offers a positive, relatively rigid vertical support.

SUMMARY OF THE INVENTION

These and other objects of this invention are achieved by the preferred embodiment disclosed herein which is a vertically self-supporting display package having a formed blister package comprising a vertical base surface having an aperture, a product enclosure extending in one direction from the inward perimeter of said aperture, said product enclosure being open in the plane of said base surface, a support structure extending in said one direction from said base surface, said support structure spaced along said base surface a predetermined distance below said product enclosure, the side of said support structure aligned with the vertical plane of said base surface being open and the horizontal side of said support structure perpendicular to said plane and most distant from said product enclosure being open to provide a three-sided horizontal support edge and a back panel adheringly secured to said base surface and covering the open side of said product enclosure.

DESCRIPTION OF THE PREFERRED EMBODIMENT

Figures 1, 2, 3:
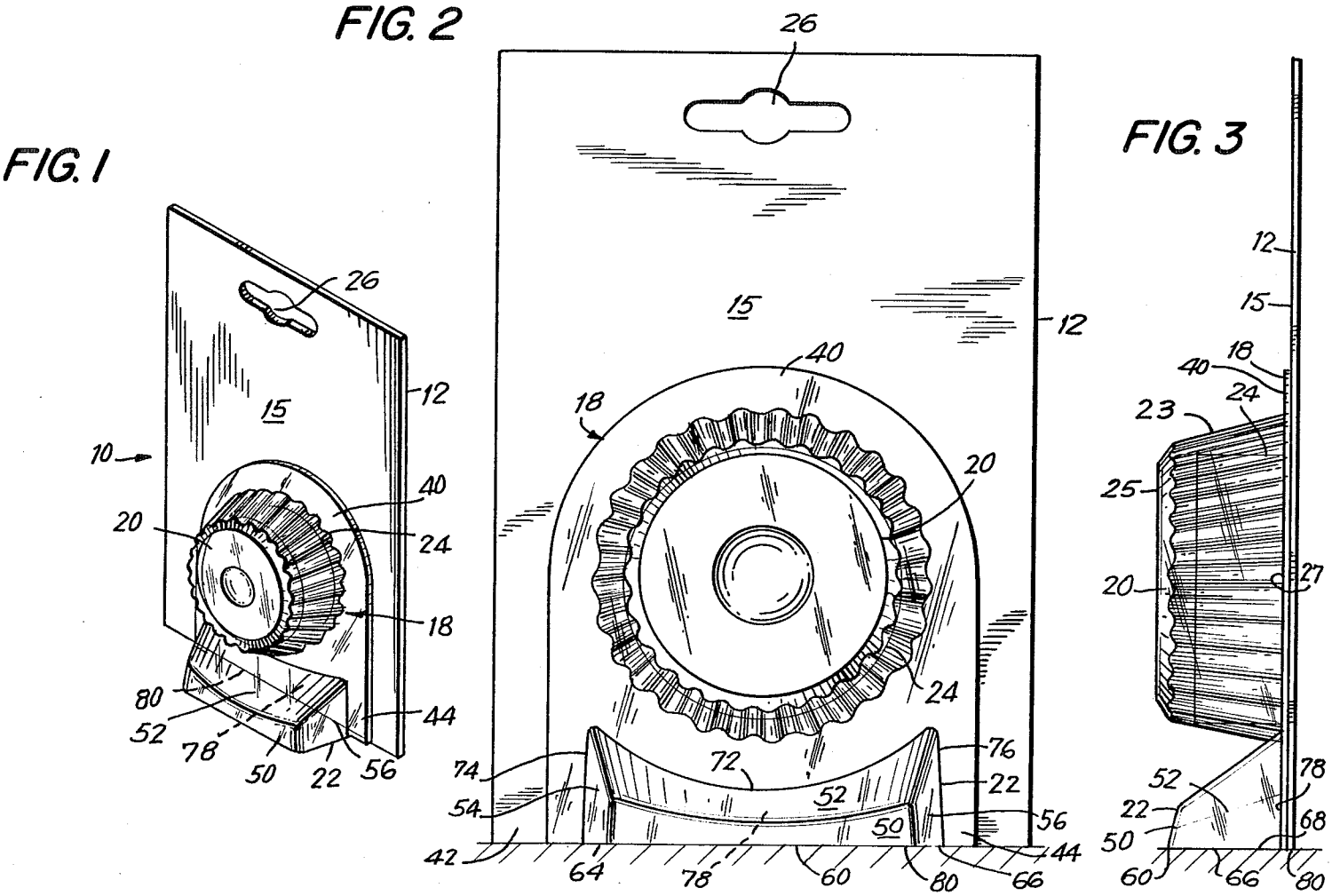
FIG. 1 shows a front perspective view of the invention.
FIG. 2 is a front elevational view of FIG. 1.
FIG. 3 is a right side elevational view of FIG. 1.

Referring now to FIGS. 1 ∝ 3, there is shown a blister package 10 embodying the principles of this invention. Package 10 is produced from a single paperboard blank 12 having a front display surface 15 and a blister pack structure 18 heat sealed or adhesively secured to display surface 15. Blister pack 18 is a formed structure having a product enclosure 20 and a support structure 22. The term "formed" as used herein means conventional shape-forming methods such as molding, thermo-forming, vacuum forming, etc. The body of product enclosure 20 extends in a generally horizontal direction and is formed of a frusto-conical wall 23 and a closed forward wall 25 and has an open back area 27 which, as will be noted below, is covered by paperboard 12. Product enclosure 20 encloses product 24. The depth of support structure 22 should be comparable to the depth of product enclosure 20 in order to prevent package 10 from falling over while not making the base excessively deep so as to occupy unnecessary shelf space. Package 10 also includes a precut (but not necessarily punched out) aperture portion 26 to enable the package to be hung if so desired.

Referring now to FIGS. 2 and 3, showing front and side elevational views of FIG. 1, it will be noted that blister pack 18 and product 24 are on the same side of display panel 12. In the preferred embodiment, product 24 is a tabletted or extruded toilet bowl cleaner which, because of the construction of blister 18 and the relative sizes of product enclosure 20 and product 24 may rest near the bottom of product enclosure portion 20 (best seen in FIG. 3). Also, while in the preferred embodiment product enclosure 20 is cup-shaped with a frusto-conical wall 23, it will be understood that many shapes may be suitable for a product enclosure and the term "cup-shaped" as used herein is intended to mean an enclosure which is closed or covered on all sides except the side covered by paperboard panel 12 or some other similar covering.

Blister pack 18 has a peripheral flange serving as sealing surface 40 which surrounds product enclosure 20 and has parallel extensions 42 and 44. It will be noted that surface 40 should be a predetermined minimal size along its periphery to accommodate conventional heat sealing equipment. While in the preferred enbodiment the product enclosure is totally sealed by having its opening covered by paperboard 12, it will be understood that certain products may not need to be totally sealed. In such situations, the opening may be covered by a mesh or other type of open-weave covering. To maintain stability of the package in use, blister pack 18 and product 24 are situated close to support structure 22 to provide low center of gravity.

Support structure 22 is a four-sided structure, integrally molded into blister pack 18 and having a front surface 50, top surface 52 and side surfaces 54 and 56. The horizontal, bottom edges 60, 64 and 66 of surfaces 50, 54 and 56, respectively, are coplanar and bound an open area 68 which may be considered the footprint of display package 10. The back edges 72, 74 and 76 of surfaces 52, 54 and 56, respectively, are coplanar and contiguous with sealing surface 40 and its extensions 42 and 44. The area bounded by edges 72, 74 and 76 is an open area 78. Display package 10 would be vertically supported by the three bottom edges 60, 64 and 66 alone, however, in the preferred embodiment paperboard panel 12 has a bottom edge 80 across the width of the panel so open area 68 is bounded on four sides. Because the paperboard is not necessary to support blister pack 18, the vertical placement of the latter on the paperboard is not critical (as it is in some prior art packages). Manufacture of display package 10 is, therefore, facilitated. The openness of the bottom of support structure 22 provides a convenient place to grasp blister pack 18 to pull it away from panel 12 to open the package. This eliminates the need for an auxiliary pull-tab such as shown in the aforementioned co-pending application.

It will be understood by those skilled in the art that numerous modifications and embodiments may be made to the preferred embodiment of the invention disclosed herein without departing from the spirit and scope thereof.

What is claimed:

1. A self-supporting display package adapted to stand alone on a horizontal surface, said package comprising:

a cup-shaped product enclosure having an opening, the body of said enclosure extending in one generally horizontal direction therefrom;

means for covering the opening of said cup-shaped product enclosure to retain a product therein;

a hollow support structure integrally formed with said product enclosure, said hollow support structure having an open bottom within a three-sided, horizontal bottom edge, all three sides of said bottom edge being adapted to rest on said horizontal surface to support said package.

2. A self-supporting display package according to claim 1 wherein said opening of said cup-shaped product enclosure and one side of said hollow support structure are in the same vertical plane and wherein all surfaces of said display package are oriented relative to said plane at a positive draft angle to enable intimate stacking of a plurality of said display packages.

3. A self-supporting display package adapted to stand alone on a horizontal surface, said package comprising:

a cup-shaped product enclosure having an opening aligned in a vertical plane, the body of said enclosure extending in one generally horizontal direction from said vertical plane;

means for covering said opening of said cup-shaped enclosure to enclose a product therein;

a vertical panel;

an annular vertical flange secured to said cup-shaped product enclosure adjacent said opening thereof, said flange secured to said panel;

a hollow support structure secured to said flange, said hollow support structure situated beneath said product enclosure and having an open bottom within a three-sided, horizontal bottom edge, all three sides of said bottom edge being adapted to rest on said horizontal surface to support said package.

4. A self-supporting display package according to claim 3 further comprising a pair of spaced, parallel, downwardly directed extension members integrally formed with said flange on each side of said cup-shaped enclosure, said hollow support structure bridging said extension members.

5. A self-supporting display package according to claim 3 wherein said flange is secured to the perimeter of said opening and outwardly directed therefrom in the plane of said opening.

6. A self-supporting display package according to claim 3 wherein said vertical panel is said covering means.

7. A self-supporting generally vertioally extending display package for displaying a product on a horizontal surface, said package comprising:

a formed blister pack structure having a vertically oriented planar base sealing surface generally in the shape of an annulus having two spaced, equal length legs tangentially extending in the same direction and downwardly from diametrically opposite sides of said base sealing surface;

a cup-shaped product enclosure integrally formed with said base sealing surface and extending in one direction therefrom, the perimeter of the opening of said cup shaped product enclosure being contiguous with the most radially inward edge of said base sealing surface;

a hollow support structure bridging said legs and extending in said one direction, said hollow support structure having an open bottom within a horizontal, three-sided bottom edge and a reinforcing structure connecting said bottom edge with said base sealing surface, all three sides of said bottom edge being adapted to rest on said horizontal surface to support said package; and a vertical back panel covering the opening of said cup-shaped product enclosure.

8. A self-supporting display package according to claim 7 wherein said back panel has a bottom edge substantially co-planar with said horizontal, three-sided bottom edge.

9. A display package according to claim 7 wherein said hollow support structure further comprises a top surface generally conforming to the bottom portion of said cup-shaped product enclosure whereby said annulus of the base sealing surface may be positioned low on said vertical panel to lower the center of gravity of said display package.

10. A vertically self-supporting blister package adapted to stand alone on a horizontal surface, said package comprising:

a formed blister package comprising a vertical base surface having an aperture;

a product enclosure extending in one direction from the inward perimeter of said aperture, said product enclosure being open in the plane of said base surface;

a hollow support structure extending in said one direction from said base surface, said hollow support structure spaced along said base surface a predetermind distance below said product enclosure, the side of said hollow support structure aligned with the vertical plane of said base surface being open and the horizontal side of said hollow support structure perpendicular to said plane and most distant from said product enclosure also being open to provide a three-sided horizontal support edge, all three sides of said bottom edge bing adapted to rest on said horizontal surface to support said package; and a back panel adheringly secured to said base surface and covering the open side of said product enclosure.

11. A vertically self-supporting blister package according to claim 10 wherein said back panel has an edge co-planar with said horizontal support edge.

12. A vertically self-supporting blister package according to claim 10 wherein said product enclosure further comprises a generally frusto-conical wall and a forward vertical surface.

* * * * *